United States Patent [19]

Belsky

[11] Patent Number: 4,957,446

[45] Date of Patent: Sep. 18, 1990

[54] LOCKOUT DEVICE FOR ELECTRICALLY OPERATED EQUIPMENT AND DEVICES

[76] Inventor: Ronald R. Belsky, 3922 W. Good Hope Rd. #5, Milwaukee, Wis. 53209

[21] Appl. No.: 448,696

[22] Filed: Dec. 11, 1989

[51] Int. Cl.[5] ..... H01R 13/44

[52] U.S. Cl. ..... 439/134; 439/367

[58] Field of Search ..... 439/133, 134, 149, 367, 439/371, 304

[56] References Cited

U.S. PATENT DOCUMENTS

| | | | |
|---|---|---|---|
| 2,654,073 | 9/1953 | Katz | 439/134 |
| 4,025,140 | 5/1977 | Matys | 439/134 |
| 4,030,795 | 6/1977 | Niemann | 439/134 |
| 4,143,933 | 3/1979 | Aitkins | 339/37 |
| 4,514,026 | 4/1985 | Herbert | 439/371 |
| 4,563,048 | 1/1986 | Im | 339/37 |
| 4,648,667 | 3/1987 | Baumgart | 339/37 |
| 4,653,824 | 3/1987 | Jason et al. | 339/37 |
| 4,679,873 | 7/1987 | Brackett, Jr. | 439/134 |
| 4,806,112 | 2/1989 | Roberts et al. | 439/135 |
| 4,812,131 | 3/1989 | Sieverman | 439/134 |

*Primary Examiner*—Paula A. Bradley

*Attorney, Agent, or Firm*—Andrus, Sceales, Starker & Sawall

[57] ABSTRACT

A housing (11) is provided for insertion of standard size prongs (12) from an electrical plug which are then secured by latching means (16) and securing means (18). The securing means prevents the removal of prongs (12) from housing (11) which in turn prevents unrestricted use of the electrical plug.

9 Claims, 1 Drawing Sheet

LOCKOUT DEVICE FOR ELECTRICALLY OPERATED EQUIPMENT AND DEVICES

BACKGROUND OF THE INVENTION

This invention relates generally to a locking device for preventing an individual, especially a minor, from plugging an electrical cord into an electric receptacle. Such electrical cords may be connected to a variety of electrically powered equipment that may pose a danger to adults or minors while operating.

The purpose of this invention is to protect individuals who do not possess sufficient knowledge or understanding of the operation of certain types of electrical equipment from potential injury. It will also allow an adult the ability to prevent his or her children from utilizing electrical devices.

SUMMARY OF THE INVENTION

In accordance with the invention, a lockout device includes a housing defining two passageways for receiving the prongs of an electrical plug, and latching means for securing the prongs within the housing.

In the preferred form of the invention, the rectangular shaped housing includes the passageways which are shaped to accept the insertion of two prongs of an electrical plug, each of which has a hole at its outer end. When the prongs are fully inserted into the housing, the hole in each prong is disposed in a cross-passage formed in the housing, which is substantially equal in dimension to that of the prong holes. The latching means, which preferably comprises a flexible strap may then be inserted through the cross-passage and the prong holes and secured, thereby preventing disengagement of the two prongs from the housing.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
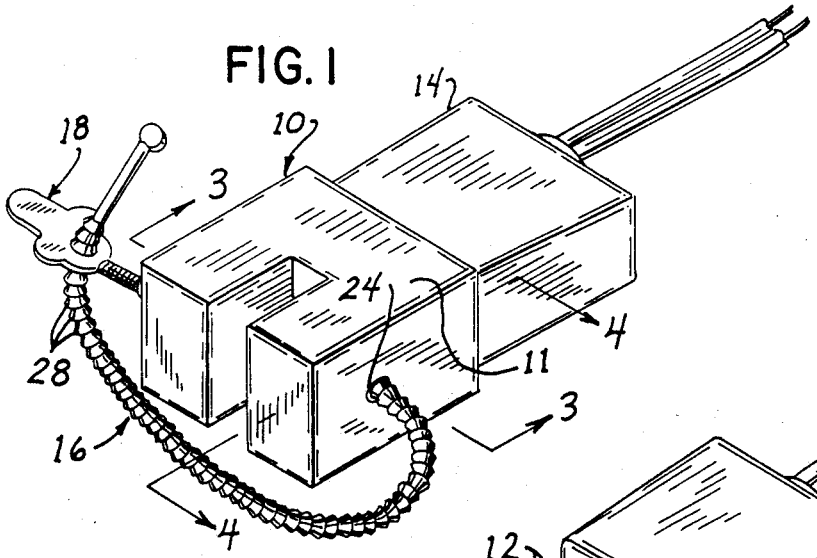
FIG. 1 is a perspective view of the invention illustrating its locked position on the end of an electrical plug.

As seen in FIGS. 1–4, a lockout device 10 is provided for preventing the use of an electrical plug 14 and its associated equipment (not shown). Lockout device 10 broadly comprises a housing 11 which receives the prongs 12 of electrical plug 14, and a latching means 16 which has a securing means 18 to prevent the removal of the prongs 12 from the device 10.

Figure 2:
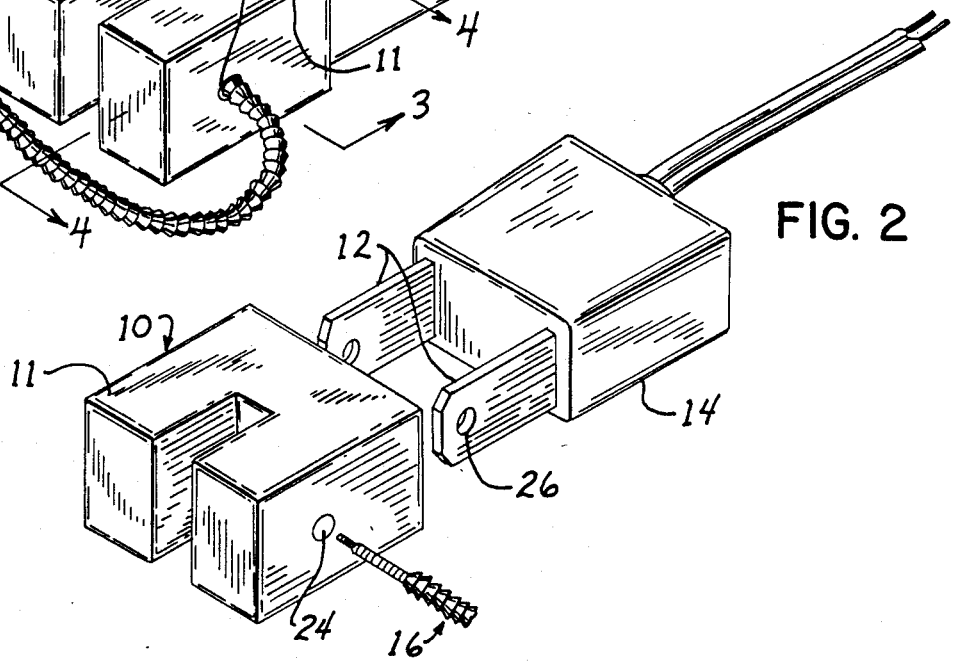
FIG. 2 is a perspective view of the invention of FIG. 1 in its unlocked position separated from the plug.
Figure 3:
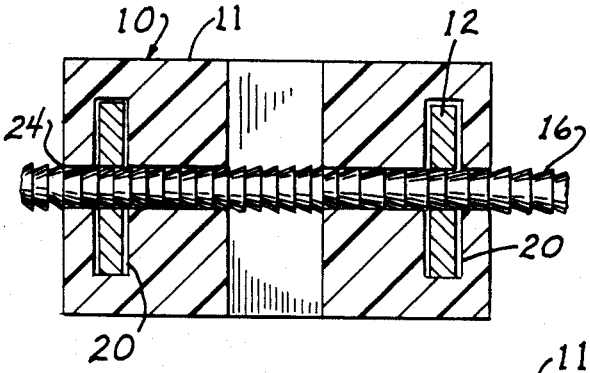
FIG. 3 is a sectional view along line 3—3 of FIG. 1.
Figure 4:
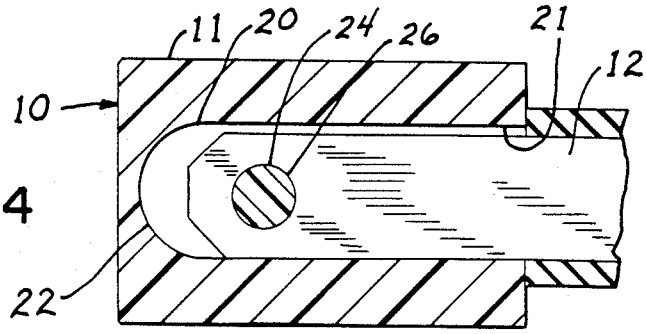
FIG. 4 is a sectional view along line 4—4 of FIG. 1.

As shown in FIGS. 1 and 2, the invention in its preferred form comprises rectangular housing 11 which defines two parallel and substantially equally sized passageways 20 (FIGS. 3 and 4). The inner end of each passageway 20 terminates in an end wall 22 and the outer end of each passageway 20 terminates in an opening 21 in housing 11. Each passageway 20 is dimensioned slightly larger than the length, width and thickness of plug prong 12 to facilitate sliding of the prongs 12 into and out of housing 11.

As is customary with electrical plugs, each of prongs 12 is provided with a hole 26 approximate its outer end.

Housing 11 further defines a cross passage 24 which has a cross-sectional diameter substantially equal to the cross-sectional diameter of prong holes 26. The cross passage 24 is positioned near the inner end of and perpendicular to passageways 20 passing through passageways 20, terminating in an opening on each side of housing 11.

Latching means 16 comprises a flexible strap which is inserted through cross passage 24 and prong holes 26 when plug prongs 12 are fully inserted into passages 20, to prevent removal of prongs 12 from housing 11 (FIGS. 3 and 4). Strap 16 may preferably be that such as manufactured by Tyton Corporation under its designation "PULLOCK". Strap 16 is constructed of a polypropylene material, and is provided with sufficient length to extend beyond each side of housing 11. Strap 16 is also provided with a plurality of one-way ratchets 28 (FIG. 1) beginning at one end of flexible strap 16 and positioned at regular intervals.

Securing means 18 is in the form of a flattened member formed integrally with strap 16, and provided with one-way hole.

The end of flexible strap 16 opposite securing means 18 is adapted to be inserted through the one-way hole in securing means 18 and pulled therethrough so that ratchets 28 engage securing means 18 adjacent the hole. This engagement prevents removal of flexible strap 16 from the cross passage 24 which, in turn, prevents removal of prongs 12 from housing 11.

In use, prongs 12 are inserted into passageways 20 and latching means 16 is passed through cross passage 24 and prong holes 26. Ratchets 28 are then placed into engagement with securing means 18 to prevent removal of strap 16.

It is understood that any satisfactory means can be employed to secure plug prong 12 within passages 20. For example, a strap such as 16 may be constructed with a reusable key-type locking mechanism. This system allows unlimited reuse of the strap, and prevents removal of the strap unless a key is used.

Various modes of carrying out the invention are contemplated as being within the scope of the following claims particularly pointing out and distinctly claiming the subject matter which is regarded as the invention.

I claim:

1. A lockout device for preventing the use of electrically operated equipment having a power cord with an electrical plug and at least two prongs, each of which are attached to and extending from the plug and terminating in an exposed end, each prong having a hole spaced from its exposed end, said device comprising:

a housing defining a first passageway, with one end of said passageway terminating in an opening disposed on an end of said housing, the other end of said passageway terminating in an end wall within said housing, said housing defining a second passageway, said second passageway disposed substantially perpendicular to and intersecting said first passageway, said first passageway having a cross-sectional dimension sufficient to accept the prong of the electrical plug, whereby the prong of the electrical plug may be disposed in said first passageway, with the hole in the prong disposed in said second passageway, wherein said second passageway passes through each of said first passageways and said second passageway terminates in a pair of openings on substantially opposite sides of said housing; and a latching means extending through said second passageway and through the hole in the prong so that removal of the prong from said first passageway is prevented, and said latching means having a securing means to prevent its removal from said second passageway.

2. The lockout device of claim 1 wherein said housing is formed from a translucent plastic, and said first passageway is dimensioned so as to align the hole of the prong with said second passageway.

3. The lockout device of claim 1 wherein said housing defines a pair of said first passageways of identical dimensions, disposed parallel to each other within said housing.

4. The lockout device of claim 1 wherein said housing defines a pair of said first passageways each having a length slightly longer than the length of a prong and a width slightly wider than the width of a prong and a thickness slightly thicker than the thickness of a prong.

5. The lockout device of claim 1 wherein said second passageway is positioned near the inner end of said first passageway and said second passageway is of cross-sectional dimension substantially equal to the dimension of the holes in the prongs.

6. A lockout device for preventing the use of electrically operated equipment having a power cord with an electrical plug and at least two prongs, each of which are attached to and extending from the plug and terminating in an exposed end, each prong having a hole spaced from its exposed end, said device comprising:

a housing defining a first passageway, with one end of said passageway terminating in an opening disposed on an end of said housing, the other end of said passageway terminating in an end wall within said housing, said housing defining a second passageway, said second passageway disposed substantially perpendicular to and intersecting said first passageway, said first passageway having a cross-sectional dimension sufficient to accept the prong of the electrical plug, whereby the prong of the electrical plug may be disposed in said first passageway with the hole in the prong disposed in said second passageway; and a latching means extending through said second passageway and through the hole in the prong so that removal of the prong from said first passageway is prevented, and said latching means having a securing means to prevent its removal from said second passageway, wherein said latching means comprises a flexible strap member dimensioned to extend through said second passageway and extend beyond said housing.

7. The lockout device of claim 6 wherein said flexible strap member includes a plurality of ratchets at regular intervals over the length of said strap.

8. The lockout device of claim 6 wherein one end of said strap member includes said securing means for engagement with said ratchets.

9. A lockout device for preventing the use of electrically operated equipment having a power cord with an electrical plug and at least two prongs each of which is attached to and extending from the plug and terminating in an exposed end, each prong having a hole disposed in its exposed end, said device comprising:

a substantially rectangular housing defining two parallel and substantially equally sized passageways, with one end of each of said passageways terminating in an opening disposed on an end of said housing and the other end of said passageways terminating in an endwall, with said passageways having a cross-sectional dimension slightly larger than each of the prongs, said housing further defining a cross passage having a cross-section of substantially equal dimension to that of the prong holes, said cross passage being disposed substantially perpendicular to and intersecting said passageways whereby each prong hole of the electrical plug is disposed in said cross passage when the prongs are inserted in said passageways, flexible strap latching means extending through said cross passage and the prong holes when the prongs are disposed in said passageways, and dimensioned to extend beyond each side of said housing and having a plurality of ratchets at regular intervals for engagement with securing means located on one end of said flexible strap.

* * * * *